US011357262B2

(12) United States Patent
Rogan

(10) Patent No.: US 11,357,262 B2
(45) Date of Patent: Jun. 14, 2022

(54) VAPORIZER UNIT HAVING A HEATING ELEMENT WITH AN ELECTRICALLY CONDUCTIVE COVER OR COATING

(71) Applicant: JT International S.A., Geneva (CH)

(72) Inventor: Andrew Robert John Rogan, Forres (GB)

(73) Assignee: JT International S.A.

( * ) Notice: Subject to any disclaimer, the term of this patent is extended or adjusted under 35 U.S.C. 154(b) by 117 days.

(21) Appl. No.: 16/611,058

(22) PCT Filed: May 17, 2018

(86) PCT No.: PCT/EP2018/062991
§ 371 (c)(1),
(2) Date: Nov. 5, 2019

(87) PCT Pub. No.: WO2018/211035
PCT Pub. Date: Nov. 22, 2018

(65) Prior Publication Data

US 2020/0120984 A1 Apr. 23, 2020

(30) Foreign Application Priority Data

May 18, 2017 (EP) ..... 17171685

(51) Int. Cl.
*A24F 40/44* (2020.01)
*A24F 40/48* (2020.01)
(Continued)

(52) U.S. Cl.
CPC ..... *A24F 40/44* (2020.01); *A24F 40/42* (2020.01); *A24F 40/46* (2020.01); *A24F 40/48* (2020.01); *A24F 40/51* (2020.01); *A24F 40/10* (2020.01)

(58) Field of Classification Search
CPC ..... A24F 40/40; A24F 40/42; A24F 40/44; A24F 40/46; A24F 40/48
(Continued)

(56) References Cited

U.S. PATENT DOCUMENTS 9,351,522 B2 5/2016 Safari
10,506,827 B2 * 12/2019 Guo ..... A24F 40/70
(Continued)

FOREIGN PATENT DOCUMENTS

EP 2879533 A1 6/2015
EP 2965642 A1 1/2016
(Continued)

OTHER PUBLICATIONS

Extended European Search Report including the Written Opinion for Application No. EP 17171685.5 dated Nov. 23, 2017, 7 pages.
(Continued)

*Primary Examiner* — Hae Moon Hyeon
(74) *Attorney, Agent, or Firm* — Lerner, David, Littenberg, Krumholz & Mentlik, LLP

(57) ABSTRACT

A vaporizer unit for a personal vaporizer device, especially an electronic smoking article, includes a housing which encloses a reservoir for storing a liquid to be vaporized; a heating element configured and arranged for heating the liquid to be vaporized to generate a vapour to be inhaled; and a liquid delivery element which is configured to convey the liquid from the reservoir to the heating element for vaporization. The liquid delivery element includes at least a first side configured to be in contact with or to form a wall of the reservoir and a second side in contact with the heating element fluidly connected with the first side and wherein the heating element includes an electrically conductive cover or
(Continued)

coating applied to the second side of the liquid delivery element. A personal vaporizer device includes the vaporizer unit.

21 Claims, 11 Drawing Sheets

(51) Int. Cl.
*A24F 40/51* (2020.01)
*A24F 40/42* (2020.01)
*A24F 40/46* (2020.01)
*A24F 40/10* (2020.01)

(58) Field of Classification Search
USPC ..... 131/328, 329
See application file for complete search history.

(56) References Cited

U.S. PATENT DOCUMENTS

| | | | | |
|---|---|---|---|---|
| 10,561,803 | B2 * | 2/2020 | Liu | A61M 15/0085 |
| 10,595,566 | B2 * | 3/2020 | Jiang | A24F 40/485 |
| 2014/0334803 | A1 | 11/2014 | Li et al. | |
| 2016/0338411 | A1 | 11/2016 | Liu | |
| 2016/0345630 | A1 | 12/2016 | Mironov et al. | |
| 2018/0029782 | A1 * | 2/2018 | Zuber | B05B 1/24 |
| 2018/0213843 | A1 | 8/2018 | Mironov | |
| 2019/0053539 | A1 * | 2/2019 | Davis | A24F 40/44 |
| 2019/0142063 | A1 * | 5/2019 | Liu | B05B 17/06 131/329 |
| 2019/0269177 | A1 * | 9/2019 | Liu | A24F 40/485 |

FOREIGN PATENT DOCUMENTS

| | | | |
|---|---|---|---|
| JP | 2017506509 | A | 3/2017 |
| JP | 2017511123 | A | 4/2017 |
| WO | 2014144678 | A2 | 9/2014 |
| WO | 2015086318 | A1 | 6/2015 |
| WO | 2015117704 | A1 | 8/2015 |
| WO | 2015150068 | A1 | 10/2015 |
| WO | 2015198015 | A1 | 12/2015 |
| WO | 2016096745 | A1 | 6/2016 |
| WO | 2016096780 | A1 | 6/2016 |
| WO | 2016124740 | A1 | 8/2016 |
| WO | 2016161554 | A1 | 10/2016 |
| WO | 2017001819 | A1 | 1/2017 |
| WO | 2017005471 | A1 | 1/2017 |

OTHER PUBLICATIONS

International Search Report including the Written Opinion from Application No. PCT/EP2018/062991 dated Jul. 12, 2018, 16 pages.

* cited by examiner

VAPORIZER UNIT HAVING A HEATING ELEMENT WITH AN ELECTRICALLY CONDUCTIVE COVER OR COATING

CROSS-REFERENCE TO RELATED APPLICATIONS

The present application is a national phase entry under 35 U.S.C. § 371 of International Application No. PCT/EP2018/062991, filed May 17, 2018, published in English, which claims priority to European Patent Application No. 17171685.5, filed May 18, 2017, the disclosures of which are incorporated herein by reference.

FIELD OF THE INVENTION

The present invention relates to a vaporizer unit for a personal vaporizer device, such as an electronic smoking article, and to a vaporizer device which includes such a vaporizer unit.

BACKGROUND OF THE INVENTION

Personal vaporizer devices, such as electronic cigarettes or "e-cigarettes" as they are also known, have gained in popularity over the past ten years as an alternative to traditional smoking articles, like cigarettes, cigars, and cigarillos. Developments in the design and configuration of such vaporizer devices are on-going to improve their performance and their reliability, as well as their ease of production and their production costs.

SUMMARY OF THE INVENTION

In view of the above, an object of the invention is to provide a new and improved vaporizer unit for a personal vaporizer device, like an electronic smoking article. In particular, it would be desirable to provide such a new and improved vaporizer unit in the form of a replaceable cartridge or capsule for a vaporizer device.

In accordance with the present invention, a vaporizer unit for a personal vaporizer device, especially an electronic smoking article, as recited in claim 1 is provided. Various advantageous and/or preferred features of the invention are recited in the dependent claims.

According to one aspect, therefore, the present invention provides a vaporizer unit for a personal vaporizer device, especially for an electronic smoking article. The vaporizer unit comprises:

- a housing which encloses a reservoir for storing a liquid to be vaporized;
- a heating element configured to heat the liquid to be vaporized to generate a vapour to be inhaled; and
- a liquid delivery means which is configured to convey the liquid from the reservoir to the heating element for vaporization;
- wherein the liquid delivery means comprises at least a first side configured to be in contact with or to form a wall of the reservoir and a second side in contact with the heating element fluidly connected with the first side and wherein the heating element comprises an electrically conductive cover or coating applied to the second side of the liquid delivery means.

In an exemplary embodiment, the heating element is a cover in the form of a flat disc-shaped element. A separate disc-shaped element provides an easy and economical manufacturing method in particular for use in a stacked susceptor and fluid transfer element structure.

The vaporization chamber may be formed at an end-portion of the vaporizer unit, the liquid delivery means and the heating element being housed within the vaporization chamber. A vaporization chamber enables vapour to leave the liquid delivery means before being transferred to the vapour flow. This reduced the risk of droplets being transferred to the vapour flow and reaching the user.

The vaporizer unit may further comprise a second liquid delivery means arranged on an opposite side of the heating element in relation to the first liquid delivery means. A second liquid delivery means may provide a filtration effect to retain larger droplets of vaporization liquid.

The vaporizer unit may further comprise an exterior housing and a cap that forms part of the exterior housing at an end-portion of the vaporizer unit, the cap comprising air inlet holes and a central opening. A cap provides a simple structure for assembly.

The vaporizer unit may further comprise a membrane configured to seal the air inlet holes to be air permeable and liquid impermeable. The membrane may reduce the risk of leakage from the air inlet holes.

The vaporizer unit may in some embodiments include an airflow path or passage which extends through the housing for guiding the vapour to a mouthpiece for inhalation by a user.

In this way, the present invention provides a vaporizer unit in which the heating element is intimately associated and/or integrated with the liquid delivery means. This provides not only an optimized construction for easy assembly of the parts of the vaporizer unit but also a most efficient transmission or delivery of the liquid to be vaporized to the heating element. The personal vaporizer device will therefore typically have a heating system that includes the heating element of the vaporizer unit. The heating system is preferably electrically driven by a power source, such as a battery, in the personal vaporizer device.

In some embodiments, the liquid delivery means may form a wall of the reservoir and the heating element comprises an electrically conductive cover or coating on the wall of the reservoir formed by the liquid delivery means. The electrically conductive cover or coating may in some embodiments interface directly with the airflow path or passage through the housing.

In some embodiments, the liquid delivery means comprises a porous material which is configured to convey the liquid from the reservoir to the heating element via capillary action. In this regard, the porous material of the liquid delivery means may, for example, comprise a ceramic, a polymer foam or a fibrous material. The fibrous material may, for example, comprise textile fibres, such as cotton, pressed into a pad or matting. The electrically conductive cover or coating of the heating element may optionally penetrate the pore structure of the porous material that forms the liquid delivery means, thereby integrating the heating element with the liquid delivery means. The electrically conductive cover or coating of the heating element may in this respect have parts of its material extend into at least a portion of the individual pores on the surface of the porous material facing the electrically conductive cover or coating.

In some embodiments, the liquid delivery means has a layered structure and includes a support layer for the porous material configured to convey the liquid from the reservoir to the heating element via capillary action. In this regard, the support layer may itself comprise a porous material such as a ceramic, a polymer foam, or a fibrous material. In particular, the support layer may provide the liquid delivery means with structural reinforcement to improve its performance as part of a wall of the reservoir. For example, the support layer of the liquid delivery means may comprise a generally flat, relatively dense pad-like layer of textile fibres, such as cotton or similar. Alternatively, the support layer of the liquid delivery means could comprise a generally flat layer of a porous ceramic or solid polymer foam.

In some embodiments, the electrically conductive cover or coating provided on the wall of the reservoir formed by the liquid delivery means is substantially porous and/or includes a plurality of holes for transmission of liquid and/or vapour there-through. In this regard, the electrically conductive cover or coating may be deposited, and especially vapour deposited or printed, on the liquid delivery means; that is, on the wall of the reservoir formed by the liquid delivery means. This way, the electrically conductive cover or coating may have or adopt a porosity that is generally consistent with the porosity of the wall. The electrically conductive cover or coating of the heating element is provided on an outer or external surface of the wall formed by the liquid delivery means, such that the heating element is outside of the reservoir. The electrically conductive cover or coating forming the heating element is preferably formed from any one of: aluminium, copper, iron, nickel, chromium, or titanium, or from an alloy of any one thereof.

In some embodiments, the extension of the electrically conductive cover or coating provided on the wall of the reservoir formed by the liquid delivery means is planar; that is the amount of extension in two perpendicular directions along the extension of the plane of the wall of the reservoir is substantially equal and by an order or magnitude larger than the thickness of the electrically conductive cover or coating in the direction perpendicular to the extension of the plane of the wall of the reservoir. Particularly, the porosity of the electrically conductive cover or coating provides for a homogeneous density distribution of apertures on any local reference scale; that is, for any given segment of the planarly formed electrically conductive cover or coating down to the value of said reference scale, the distribution of holes in the electrically conductive cover or coating is essentially the same. This has the advantage that both the amount of vaporized liquid as well as the speed and efficiency of vaporization are homogenously and evenly distributed over the whole surface of the reservoir covered by the electrically conductive cover or coating.

In some embodiments, the surface area not covered by the electrically conductive cover or coating, that includes the area of holes, pores or apertures formed due to the porosity of the electrically conductive cover or coating, is 30% or less, especially 20% or less, more especially 15% or less, more especially 10% or less, and even more especially 5% or less of the whole surface area on the wall of the reservoir formed by the liquid delivery means. Advantageously, this enhances the efficiency of the vaporization process due to the electrically conductive cover or coating being able to heat up more evenly and homogeneously than wires or filaments.

In some embodiments, the liquid delivery means is generally flat or plate-like and forms at least a part of an end wall of the reservoir for storing the liquid to be vaporized. This end wall of the reservoir is typically at a first end of the reservoir, and the electrically conductive cover or coating at least partially covers an outer surface of the end wall, and optionally may substantially entirely, cover the outer surface of that end wall. For example, where the reservoir enclosed by the housing for storing the liquid to be vaporized is generally cylindrical, the liquid delivery means is generally a disc-shaped wall, and electrical current may flow radially through the electrically conductive cover or coating on the disc-shaped wall. The electrically conductive cover or coating may only partially cover the outer surface of the end wall. For example, where the liquid delivery means forms a generally disc-shaped wall, the electrically conductive cover or coating may also be disc-shaped, but may optionally be slightly smaller than the disc-shaped wall on which it is provided.

In some embodiments, the liquid delivery means comprises a central aperture that surrounds and at least partially forms or communicates with the airflow path or passage. This is especially the case when the liquid delivery means comprises a generally disc-shaped wall. The air-flow path preferably passes through the central aperture of the liquid delivery means after interfacing with and/or contacting the electrically conductive cover or coating of the heating element. In a preferred embodiment of the invention, therefore, the electrically conductive cover or coating which forms the heating element may comprise a central hole or aperture that surrounds and at least partially forms or communicates with the airflow path or passage.

The vaporizer unit may have a central channel and wherein the heating element is placed so that the central channel extends through the aperture and wherein the vaporization chamber has a vapour outlet to the central channel. The central channel may have a constricted section, an upstream portion and a downstream portion, wherein the constricted portion has a reduced cross-sectional area in relation to the upstream portion, and wherein the vapour outlet of the vaporization chamber is located in the constricted section. By this configuration, a Venturi effect can be created and dimensioned such that the smaller vapour droplets are moved into the vapour flow through the central channel.

In some embodiments, the air-flow path or passage includes a channel that extends longitudinally, and preferably centrally, through the housing. Particularly, the liquid delivery means may at least partially define the channel and may surround or encompass the channel. The electrically conductive cover or coating therefore may in particular interface directly with the airflow path or passage through the channel. This way, vapour generated at the electrically conductive cover or coating which forms the heating element can be directly and efficiently picked up and carried by the air-flow through the vaporizer unit along the airflow path or passage towards the user.

In some alternative embodiments, the liquid delivery means has a generally cylindrical configuration and forms an inner wall of the reservoir extending in an axial direction along the channel. The electrically conductive cover or coating of the heating element at least partially covers an inner surface of the cylindrical inner wall (that is external of the reservoir), and preferably extends around a full circumference of the cylindrical inner wall.

In some embodiments, a first electrode is provided to electrically connect the electrically conductive cover or coating of the heating element with a power source, such as a battery, of the personal vaporizer device. The first electrode may be arranged generally centrally of the housing for contact with a central region of the electrically conductive cover or coating. For example, the first electrode may comprise a tube having an opening on its surface. In this way, the opening and a hole of the tube may form a part of the airflow path or passage. This configuration has the advantage that the use of electrical connecting wires may be avoided in the electrodes, which provides for easy assembly and a more robust and more reliable construction. A second electrode may be provided to connect the electrically conductive cover or coating of the heating element with a power source, such as a battery. The second electrode may be arranged outside a region of the electrically conductive cover or coating. The second electrode preferably at least partially surrounds the electrically conductive cover or coating, and preferably comprises a side wall of the housing that substantially surrounds or encompasses an end wall of the reservoir. Again, this configuration of the second electrode avoids the use of electrical connecting wires and provides for easy assembly and a very robust and reliable construction. Also, by employing a wall of the housing as an electrode, the number of individual component parts of the vaporizer unit can be reduced.

In some alternative embodiments, the heating element of the vaporizer unit, especially the electrically conductive cover or coating, comprises a susceptor which is adapted to be heated by an induction coil. Thus, the heating system of the vaporizer device may comprise induction coil. The induction coil may, for example, be incorporated in a casing of the vaporizer device for generally surrounding the susceptor (i.e. the heating element of the vaporizer unit) when the vaporizer unit is installed in the vaporizer device.

According to another aspect, the present invention provides a personal vaporizer device, especially an electronic smoking article, which comprises a vaporizer unit according to any one of the embodiments described above. The vaporizer unit may in particular be replaceable and/or disposable. For example, the vaporizer unit may be provided in the form of a cartridge.

In an exemplary embodiment, the personal vaporizer device may further comprise a receiving cavity adapted to engage with the vaporizer unit, wherein a temperature sensor is located in the receiving cavity, the temperature sensor comprising a measuring probe having a first end attached to the receiving cavity and a second protruding free end. The protruding free end may have a tip.

BRIEF DESCRIPTION OF THE DRAWINGS

For a more complete understanding of the invention and the advantages thereof, exemplary embodiments of the invention are explained in more detail in the following description with reference to the accompanying drawing figures, in which like reference characters designate like parts and in which.

Figure 1:
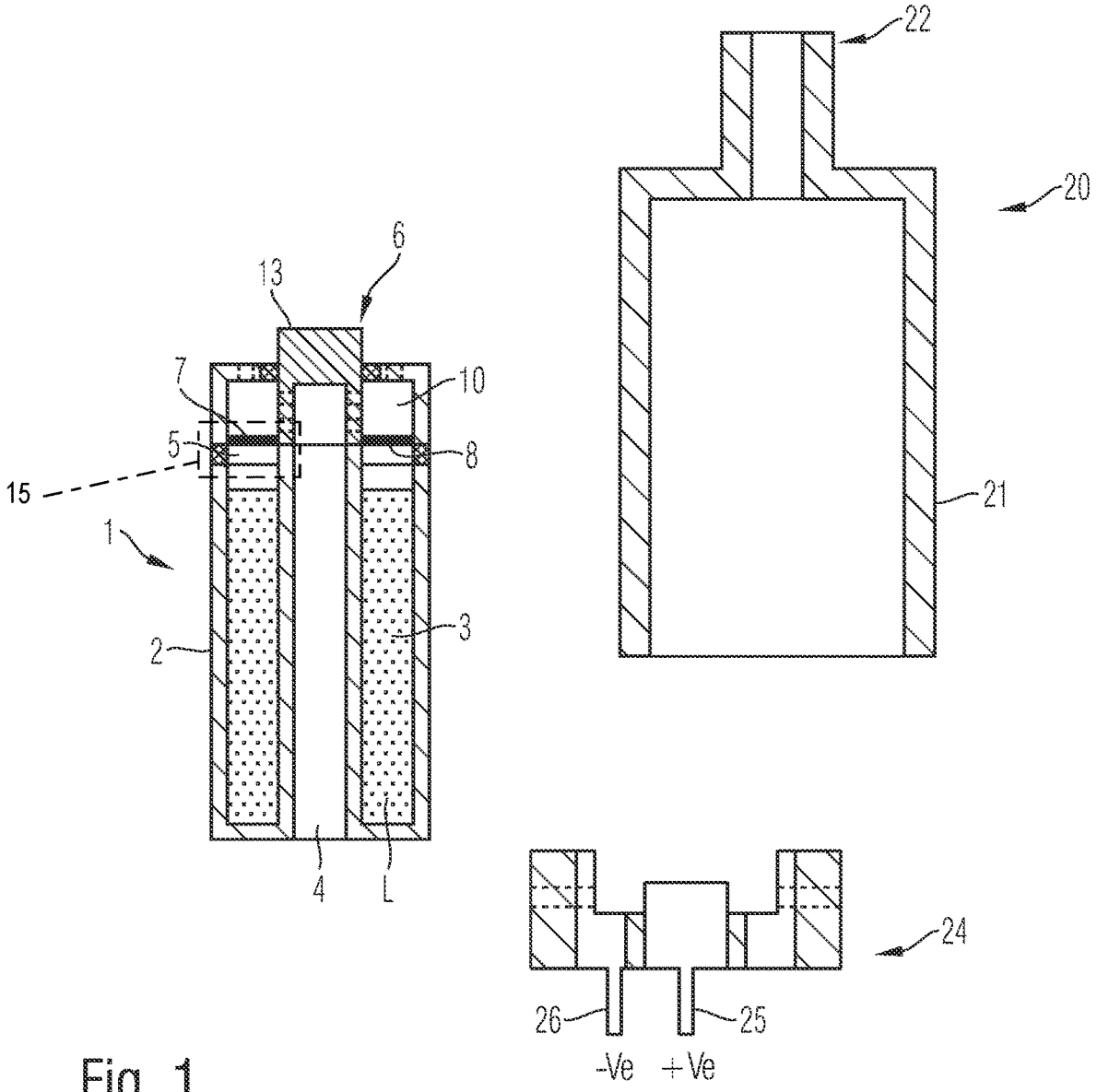
FIG. 1 is a schematic cross-sectional side view of a vaporizer unit and part of a personal vaporizer device, such as an electronic smoking article, according to some embodiments.

The accompanying drawings are included to provide a further understanding of the present invention and are incorporated in and constitute a part of this specification. The drawings illustrate particular embodiments of the invention and together with the description serve to explain the principles of the invention. Other embodiments of the invention and many of the attendant advantages of the invention will be readily appreciated as they become better understood with reference to the following detailed description.

It will be appreciated that common and/or well understood elements that may be useful or necessary in a commercially feasible embodiment are not necessarily depicted in order to facilitate a more abstracted view of the embodiments. The elements of the drawings are not necessarily illustrated to scale relative to each other. It will further be appreciated that certain actions and/or steps in an embodiment of a method may be described or depicted in a particular order of occurrences while those skilled in the art will understand that such specificity with respect to sequence is not actually required. It will also be understood that the terms and expressions used in the present specification have the ordinary meaning as is accorded to such terms and expressions with respect to their corresponding respective areas of inquiry and study, except where specific meanings have otherwise been set forth herein.

DETAILED DESCRIPTION OF EMBODIMENTS

With reference firstly to FIGS. 1 to 4 of the drawings, a vaporizer unit 1 in the form of a replaceable cartridge is configured for use in a personal vaporizer device 20, such as an electronic cigarette or "e-cigarette". The vaporizer unit 1 comprises a generally cylindrical housing 2 which encloses a reservoir 3 for storing a liquid L to be vaporized. The reservoir 3 may in some embodiments be implemented as a buffer. In some embodiments, the reservoir 3 may be formed as a buffer. In some embodiments, the reservoir 3 may be called a buffer. In some embodiments, the reservoir 3 may comprise a buffer. In some embodiments, the reservoir 3 may have the same functionality as a buffer. Generally spoken, the reservoir 3 may be a liquid container containing liquid L to be vaporized directly. In other forms, the reservoir 3 may act as a buffer for transferring liquid L to be vaporized from a liquid container to a liquid delivery member 5. In some embodiments, liquid L may initially be held in a liquid container of a liquid capsule and a capillary needle attached to a reservoir portion formed as a buffer may be used to pierce a shell of the capsule. Liquid L is then transferred through the capillary needle to the buffer from where it is further transferred to a liquid delivery member 5. In this regard, the liquid capsule may be replaced independently of the reservoir 3 with the liquid delivery member 5 and the capillary needle which components may form parts of an atomizer section. The housing 2 includes a central channel 4 that extends longitudinally and generally centrally there-through and the reservoir 3 is arranged in the housing 2 such that it substantially surrounds the central channel 4 in an annular manner.

Figure 2:
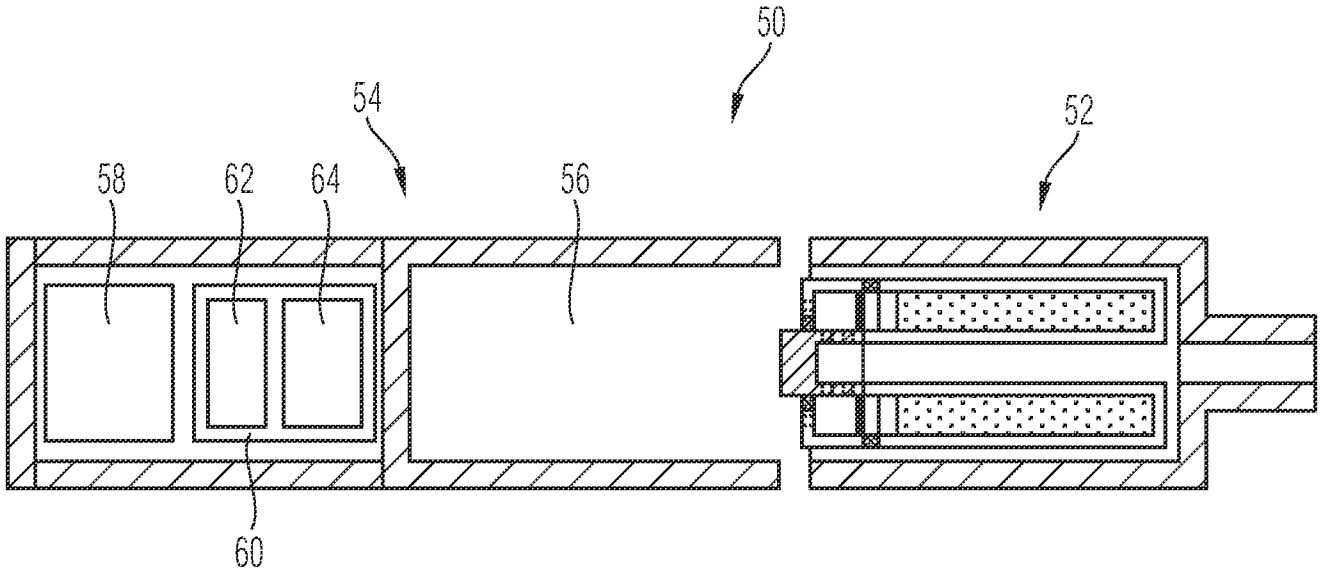
FIG. 2 is a schematic cross-sectional side view of a vaporizer unit and part of a personal vaporizer device, such as an electronic smoking article, according to some embodiments.
Figure 3A:
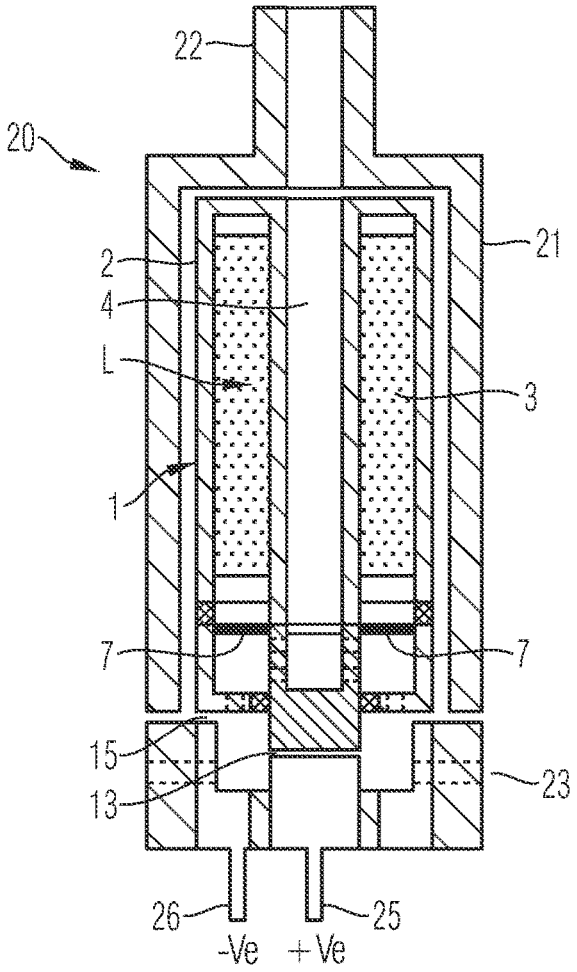
FIG. 3*a* is a schematic cross-sectional side view of the vaporizer unit of FIG. 1 installed in the personal vaporizer device of FIG. 1.
Figure 3B:
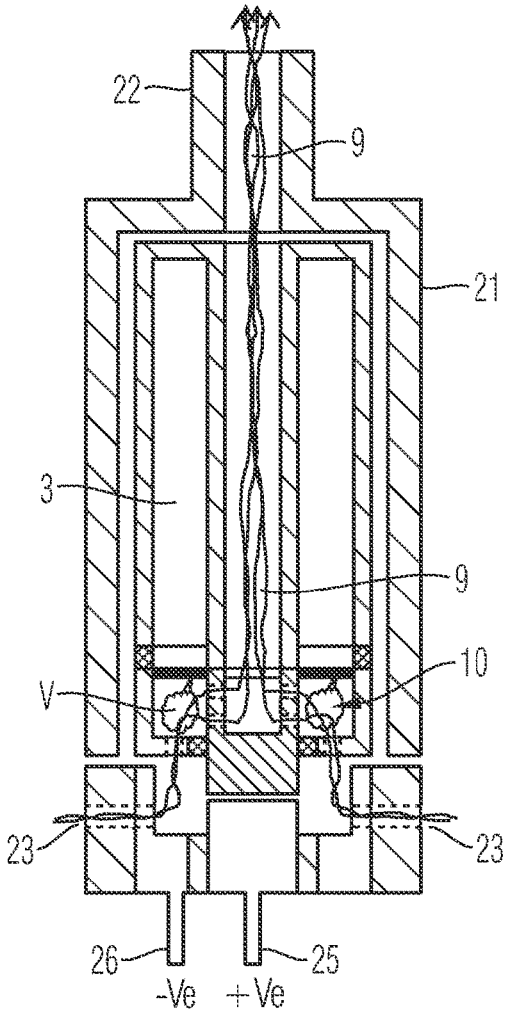
FIG. 3*b* is a schematic cross-sectional side view of the vaporizer unit of FIG. 1 in use in the personal vaporizer device of FIG. 1.

The vaporizer unit 1 further comprises a liquid delivery member 5 for conveying the liquid L from the reservoir 3 or the buffer for vaporization by a heater or heating system 6. In this regard, the liquid delivery member 5 is generally plate-like and disc-shaped and forms an end wall of the reservoir 3. When the vaporizer unit 1 is inserted and installed in the personal vaporizer device 20 in use, i.e. in a casing 21 of the personal vaporizer device 20 as shown in FIGS. 2 and 3, the liquid delivery member 5 forms a lower end wall of the reservoir 3, such that the liquid L in the reservoir 3 or the buffer covers and wets that liquid delivery member 5 under gravity. The liquid delivery member 5 is comprised of a porous ceramic material for conveying the liquid L from the reservoir 3 there-though by capillary action. It will be noted that instead of a porous ceramic, other porous materials, e.g. a foamed polymer or a fibrous material, are also conceivable for the liquid delivery member 5.

Referring further to FIGS. 1 to 4 of the drawings, the vaporizer unit 1 comprises a heating element 7 which is configured and arranged for heating the liquid L to be vaporized to generate a vapour V to be inhaled by a user of the personal vaporizer device 20. The heating element 7 comprises an electrically conductive cover or coating on the wall of the reservoir 3 formed by the liquid delivery member 5. To this end, the electrically conductive cover or coating is deposited, typically vapour deposited or printed, on an outer surface 8 of the liquid delivery member 5. In this way, like the liquid delivery member 5 itself, the heating element 7 is substantially porous and/or includes a plurality of holes or pores for the transmission there-through of the liquid L and/or the vapour V formed by heating the liquid L. When being deposited on the liquid delivery member 5, parts of the material of the electrically conductive cover or coating extend into at least some of the individual pores on the surface of the liquid delivery member 5 that faces the electrically conductive cover or coating.

An exemplary personal vaporizer device 50 is illustrated in FIG. 2. The personal vaporizer device 50 can be used as an electronic cigarette, for example as a substitute for a traditional combustion cigarette. The personal vaporizer device 50 comprises a mouthpiece portion 52 and a power supply portion 54 in a main body. The mouthpiece portion 52 comprises a cavity 56 configured to receive replaceable cartridges, such as the vaporizer unit 1. The power supply portion 54 comprises a power supply unit 58, such as a battery, and electrical circuitry 60 which enables operation of the personal vaporizer device 50. The power supply portion 54 is thus configured to supply power to the heating element 7 in the vaporizer unit 1 via electrical circuitry 60 comprising a memory 62 and a controller 64.

Figure 8:
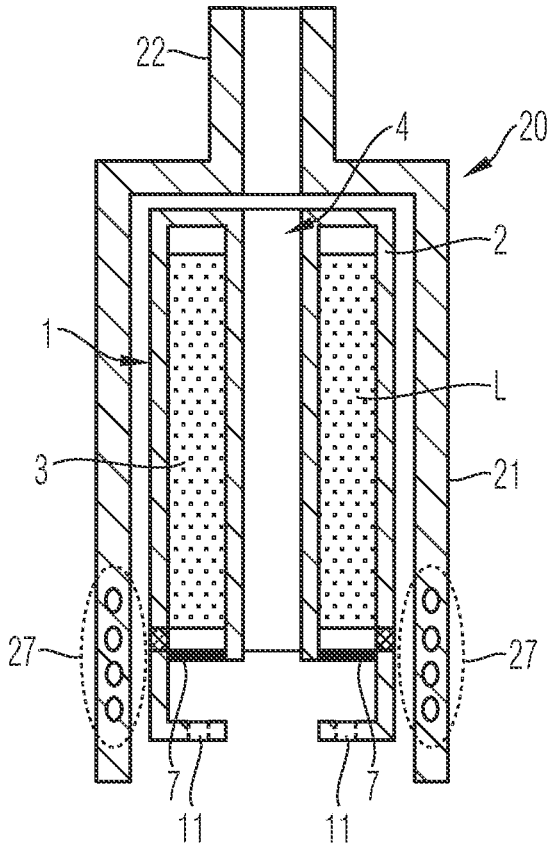
FIG. 8 is a schematic cross-sectional side view of a vaporizer unit installed in a personal vaporizer device, such as an electronic smoking article, according to some other embodiments.

As illustrated in FIG. 8, as an alternative to coating a liquid delivery member 5, the heating element 7 can be a flat disc-shaped susceptor element formed as a separate part from the liquid delivery member 5. The heating element 7 can for example be formed by a metal punching process of sheet metal to obtain a susceptor ring.

As shown, the heating element 7 may be planar such that it evenly extends over the outer surface 8 of the liquid delivery member 5. At the same time, its thickness on the outer surface 8 of the liquid delivery member 5 is comparably low so that the heating element 7 also forms a disc-shaped component. The heating element 7 may have its pores or holes evenly distributed over the outer surface 8 so that the amount of vaporized liquid and the vaporization speed and efficiency may be well controlled over the whole outer surface 8. For example, the surface area not covered by the heating element 7 with respect to the outer surface 8 may be 30% or less, 20% or less, 15% or less, 10% or less, or 5% or less. In other words, the percentage of the area left open due to the pores or holes may be 30% or less, 20% or less, 15% or less, 10% or less, or 5% or less of the whole outer surface area 8. A higher percentage of coverage of material of the heating element 7 on the outer surface 8 may enhance the efficiency of the vaporization process.

Figure 4:
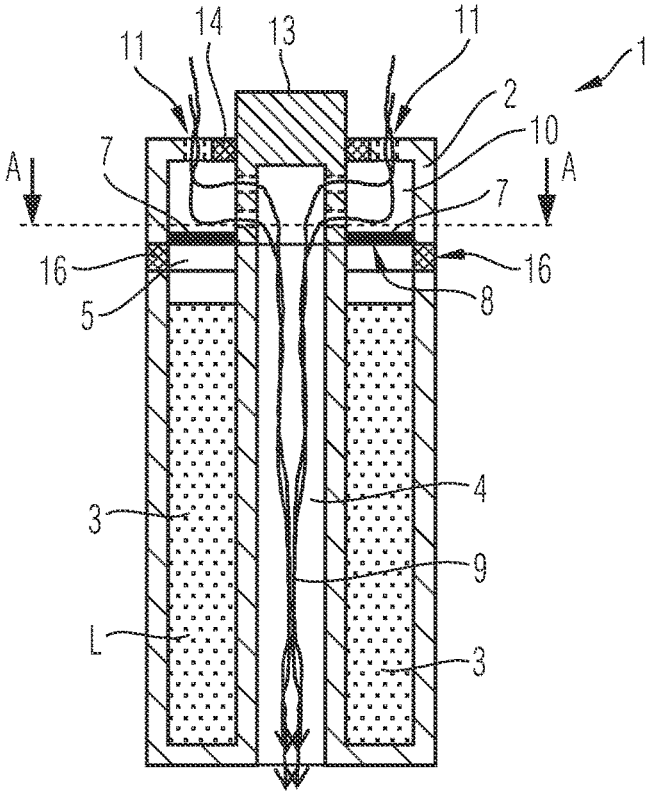
FIG. 4 is a schematic cross-sectional side view of a vaporizer unit according to some embodiments.

With particular reference to FIGS. 3 and 4 of the drawings, it will be seen that the vaporizer unit 1 includes or defines an airflow path or passage 9 which extends through the housing 2 for guiding the vapor V to a mouthpiece 22 of the personal vaporizer device 20 for inhalation by a user. The electrically conductive cover or coating, which in this embodiment forms the heating element 7, interfaces directly with the airflow path or passage 9 through the housing 2, so that the vapor V generated at the heating element 7 can pass directly into the airflow and be carried to the mouthpiece 22 for inhalation by the user. The region of the airflow path or passage 9 directly adjacent to the heating element 7 preferably forms a vapor or vaporization chamber 10 in which mixing of the vapor V and the air moving along the airflow path or passage 9 takes place. The airflow path or passage 9 includes inlet holes 11 for air entering the housing 2 of the vaporizer unit 1 and outlet holes 12 (see FIG. 7) for the air/vapour mixture passing from the vapor or vaporization chamber 10 into the central channel 4. As is apparent from FIG. 3, the casing 21 of the personal vaporizer device 20 also includes inlet holes 23 for the ingress or inlet of air into the e-cigarette when a user draws or puffs upon the mouthpiece 22.

The vaporization chamber 10 is preferably provided at an end-portion of the vaporizer unit 1. An internal space is defined between the housing 2 and the liquid delivery member 5. The internal space avoids the vapour from being drawn directly through a wick to the central channel 4. Instead, the present configuration enables a free vaporization space from which the vapour flows. This avoids unvaporized liquid from being drawn from the liquid delivery member 5 into the vapour airflow.

Figure 5:
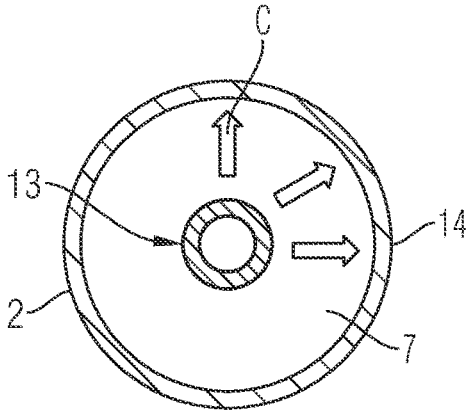
FIG. 5 is a schematic cross-sectional side view of the vaporizer unit in FIG. 4 taken in the direction of arrows A-A.

The personal vaporizer device 20 includes an electrical power source in the form of a battery 58 (see FIG. 2) which connects to an end region 24 of the casing 21 shown FIGS. 1 to 3. To this end, the end region 24 of the casing 21 includes two electrodes 25, 26 for making electrical connection with a cathode (+) and anode (−) of the battery, respectively. The vaporizer unit 1 includes a first electrode 13 which is provided for electrically connecting the electrically conductive cover or coating of the heating element 7 with the battery via the electrode 25 at the end region 24 of the casing 21. The first electrode 13 is arranged centrally of the housing 2 and is in electrical contact with a central region of the electrically conductive coating of the heating element 7. In this embodiment, the first electrode 13 has a generally tubular configuration and is designed to communicate with or form a part of the airflow path or passage 9. A first insulator 14, which in this embodiment is substantially ring-shaped, surrounds the first electrode 13 and is configured to electrically isolate the first electrode 13 from the housing 2 of the vaporizer unit 1. The vaporizer unit 1 also has a second electrode 15 provided for electrically connecting the electrically conductive cover or coating of the heating element 7 with the battery via the electrode 26 at the end region 24 of the casing 21. The second electrode 15 is arranged around a periphery of, and at least partially surrounds, the electrically conductive coating of the heating element 7. In particular, the second electrode 15 may be incorporated in, or comprise part of, a side wall of the housing 2 that substantially surrounds or encompasses the end wall of the reservoir 3 formed by the liquid delivery member 5. As shown in FIG. 5, therefore, the electrical current C may flow radially through the electrically conductive coating on the outer surface 8 of the disc-shaped wall. A second insulator 16 may also be provided to electrically isolate the second electrode 15 from other parts of the housing 2. To this end, the second insulator 16 is also substantially ring-shaped in this embodiment and is incorporated in the wall of the housing 2 adjacent to the liquid delivery member 5. It will be appreciated, of course, that the housing 2 itself may be formed of an electrically insulating material, in which case no second insulator 16 would need to be incorporated in the wall of the housing 2.

Figure 6:
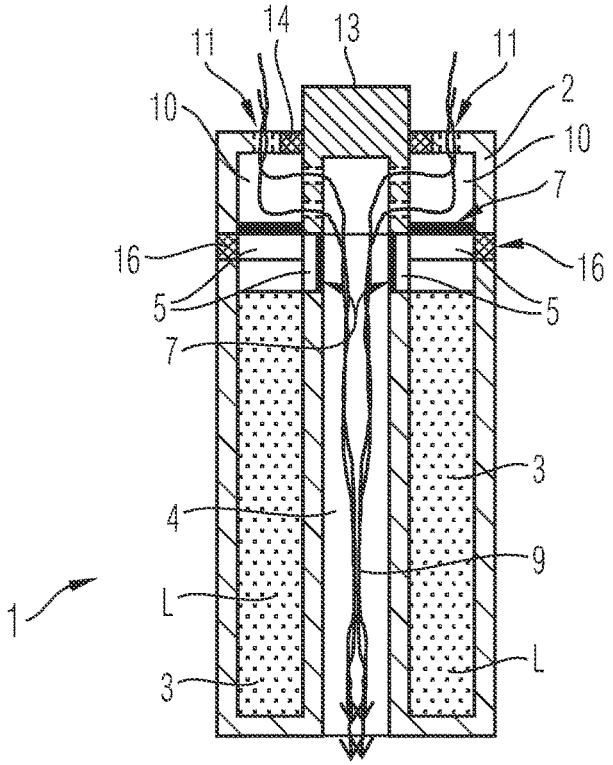
FIG. 6 is a schematic cross-sectional side view of a vaporizer unit according to some other embodiments.

FIG. 6 of the drawings illustrates another embodiment of a vaporizer unit 1. This embodiment is similar to that of FIG. 4, but in this case, in addition to the part that forms the end wall of the reservoir, the liquid delivery member 5 also includes a part having a generally cylindrical configuration forming an inner wall of the reservoir 3 extending in an axial direction along the central channel 4. Thus, the electrically conductive cover or coating of the heating element 7 also covers an inner surface of the cylindrical inner wall (i.e. external of the reservoir), and extends around a full circumference of the cylindrical inner wall. It will be noted that the part of the liquid delivery member 5 forming the end wall of the reservoir 3 could be omitted in this case, such that only the cylindrical part forming the inner wall of the reservoir 3 along the central channel 4 is present with its respective heating element 7.

Figure 7:
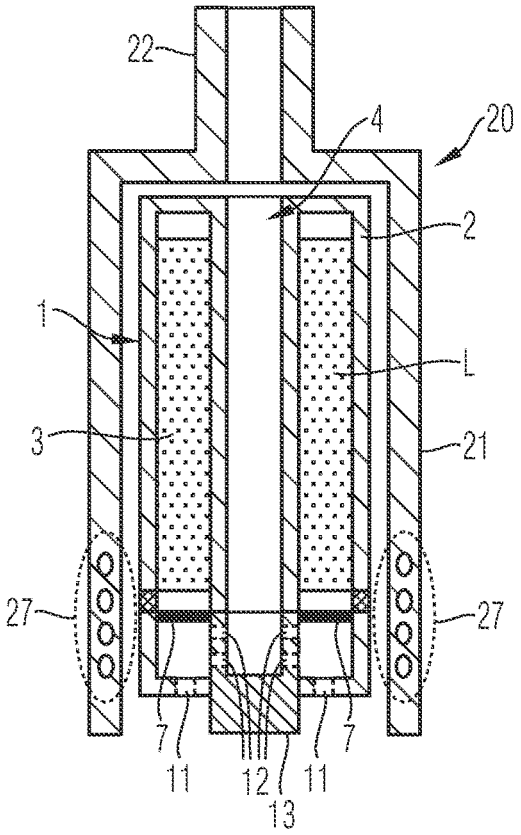
FIG. 7 is a schematic cross-sectional side view of a vaporizer unit installed in a personal vaporizer device, such as an electronic smoking article, according to some other embodiments.

With reference now to FIG. 7 of the drawings, an alternative embodiment is shown in which the heating element 7 of the vaporizer unit 1, specifically the electrically conductive cover or coating, comprises or forms a susceptor which is adapted to be heated by an induction coil 27. In this embodiment, the induction coil 27 is arranged in a wall of the casing 21 so that it may generally surround the heating element 7. Thus, the heater or heating system 6 of this alternative embodiment typically includes the induction coil 27 for inducing heat in the heating element 7. In this embodiment, therefore, as illustrated in FIG. 8, the first and second electrodes 13, 15 described above are not necessary. The other components and parts of the personal vaporizer device 20 and of the vaporizer unit 1, however, remain essentially unchanged.

The vaporizer unit 1 can therefore be implemented with a simplified structure, as no connection is needed to electrical contacts of a heater. When the vaporizer unit 1 is located inside a personal vaporizer device 50 as a replaceable cartridge, the vaporization chamber 10 is advantageously provided at an end distal to the mouthpiece portion 52 of the personal vaporizer device 50.

Figure 10A:
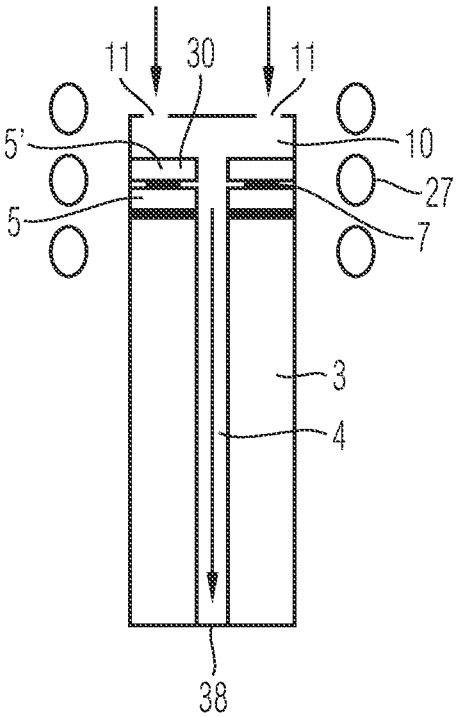
FIG. 10*a/b/c* are schematic cross-sectional side and top views of a vaporizer unit according to further embodiments.
Figure 10B:
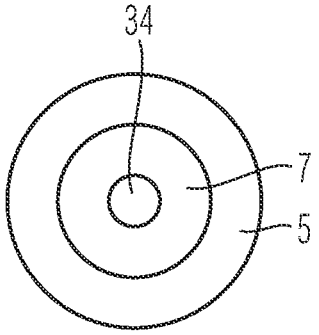

As seen in FIG. 10, the cartridge may be arranged similar to the embodiment of FIG. 8, but may further comprise a second liquid delivery member 5', additional to the first liquid delivery member 5. The heating element 7 is located in-between the first liquid delivery member 5 and the second liquid delivery member 5', i.e. in a sandwich configuration. An advantage of having a second liquid delivery member 5' is that the second liquid delivery member 5' which is located on the top of the heating element 7 acts as a filter configured to retain large liquid projections. Hence, the second liquid delivery member 5' is configured as a filter that retains the larger liquid droplets in the vapor flow. The size of the particles retained by the second liquid delivery member 5' are found to be 0.1 mm or larger.

The susceptor (i.e. the heating element 7) can be a coating as previously described. However, it can also be a flat metallic separate part covering the first liquid delivery member 5 and configured for resistive heating. The susceptor may comprise aluminium, iron, nickel, chromium, stainless steel and alloys thereof, e.g. nickel chromium. As best seen in FIGS. 9*a*, 9*b* and 10*a*, 10*b*, the susceptor can be circular or ring-shaped and provided with an aperture 34. The aperture 34 is placed and shaped to encircle the central channel 4. In the embodiment illustrated in FIGS. 10*a* and 10*b*, the susceptor is provided with a symmetrical ring-shape. The cross-sectional area of the susceptor is smaller than the cross-sectional area of the liquid delivery members 5, 5' so that vapour can pass through the area where the susceptor is not overlaying the liquid delivery members 5, 5'. Hence, the susceptor allows vapour to pass around the sides of it and/or through parts of the aperture 34.

Figure 10C:
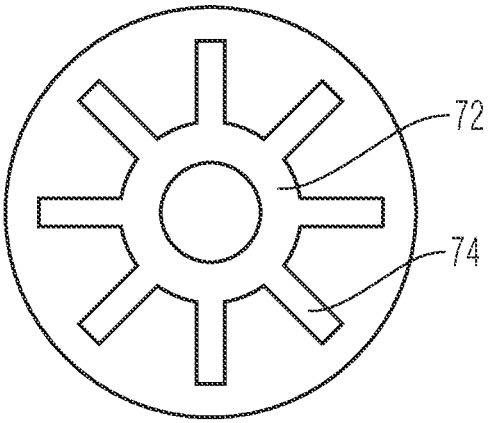

Alternatively, the susceptor (i.e. the heating element 7) can be provided with further apertures in its main disc body to enable vapour to flow through the susceptor itself. Alternatively, as illustrated in FIG. 10*c*, the heating element 7 may have a circular internal portion 72 and fins or spokes 74 connected to the circular internal portion 72 and extending in the radial direction. The circular internal portion 72 will be primarily heating through Induction heating and reach a higher temperature than the fins or spokes 74. The fins or spokes 74 will be heated primarily through conduction of the heat from the circular internal portion 72. As the circular internal portion 72 has a higher temperature than the fins or spokes 74, it is also possible to align the liquid delivery member 5, 5' so that the liquid delivery member 5, 5' is only in contact with the fins or spokes 74.

Figure 9A:
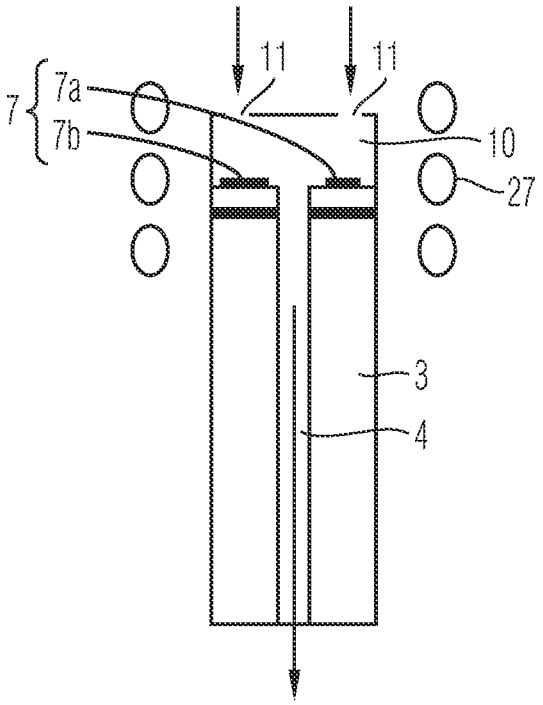
FIG. 9*a/b* are schematic cross-sectional side and top views of a vaporizer unit according to some embodiments.
Figure 9B:
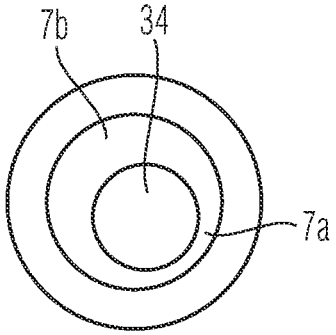

As seen in FIGS. 9*a* and 9*b*, the aperture 34 in the susceptor (i.e. the heating element 7) can be provided off-centered. This results in that a ring-shaped susceptor with a thinner portion 7*a* and a wider portion 7*b*. The electrical resistance of the susceptor is thus higher in the thinner portion 7*a* than in the wider portion 7*b*.

The higher resistance in thinner portion 7*a* leads to higher temperatures over the thinner portion 7*a* during excitation of ring currents in the susceptor (i.e. heating element 7), allowing the thinner portion 7*a* to fuse when exposed to an excessive temperature. The susceptor is configured to fuse when no liquid is present, which correspond to a temperature of approximately 350° C. The weak point is dependent on the material of the susceptor, and the power supplied by the device.

As seen in FIGS. 14*a* to 14*d*, the housing 2 can be formed by a receptacle part 2' and an end-cap or cap 32. The cap 32 is preferably located at an end portion in the axial direction of the vaporizer unit 1, which is in the proximity to the vaporization chamber 10. The cap 32 can be provided with inlet holes 11 for the incoming air. In an advantageous embodiment, the total area of the intake holes is equal or larger than to an area of an outlet 38 from the central channel 4. In such a way, air restriction in the vaporization chamber 10 is reduced such that no vacuum effect is imposed on the liquid in the reservoir 3. By reducing the vacuum in the reservoir 3, leakage from the reservoir 3 can also be reduced. In an exemplary embodiment, the cross-sectional area of the outlet 38 is around 2.5 $mm^2$ and the total area of the inlet holes 11 is 3.0 $mm^2$.

Figure 14A:
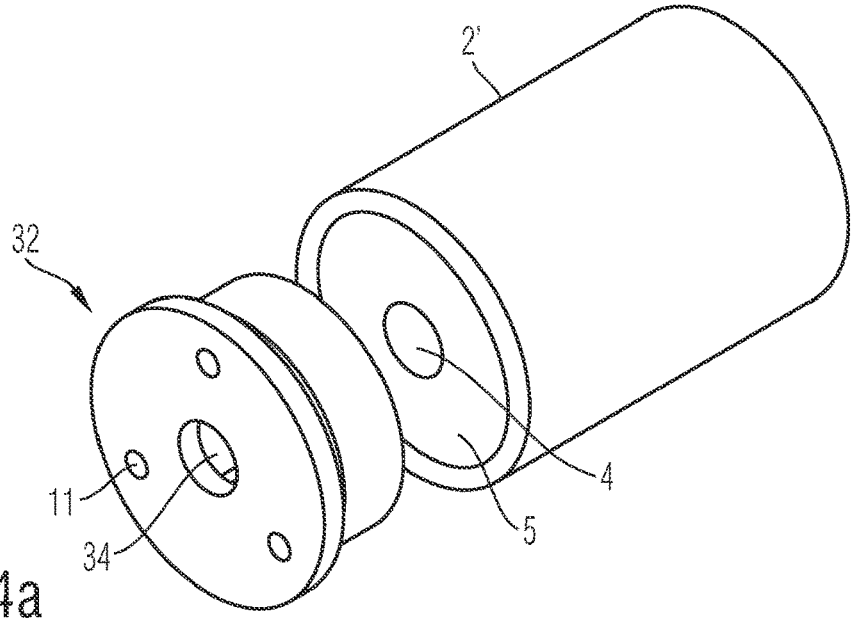
FIG. 14*a/b/c/d* are schematic perspective views of top caps for a vaporizer unit according to further embodiments.
Figure 14B:
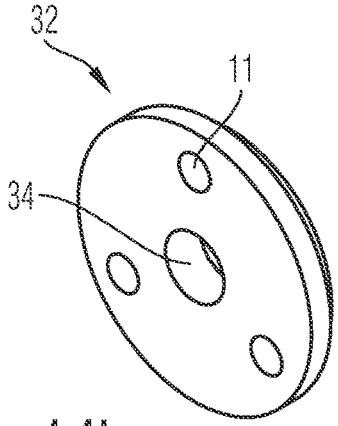
Figure 14C:
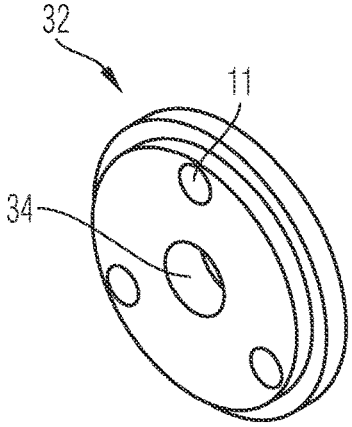
Figure 14D:
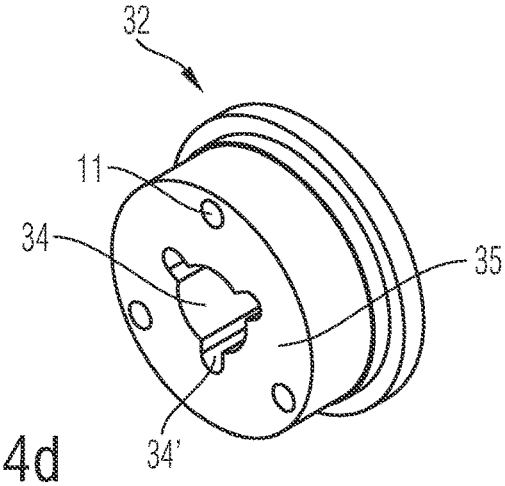
Figure 15:
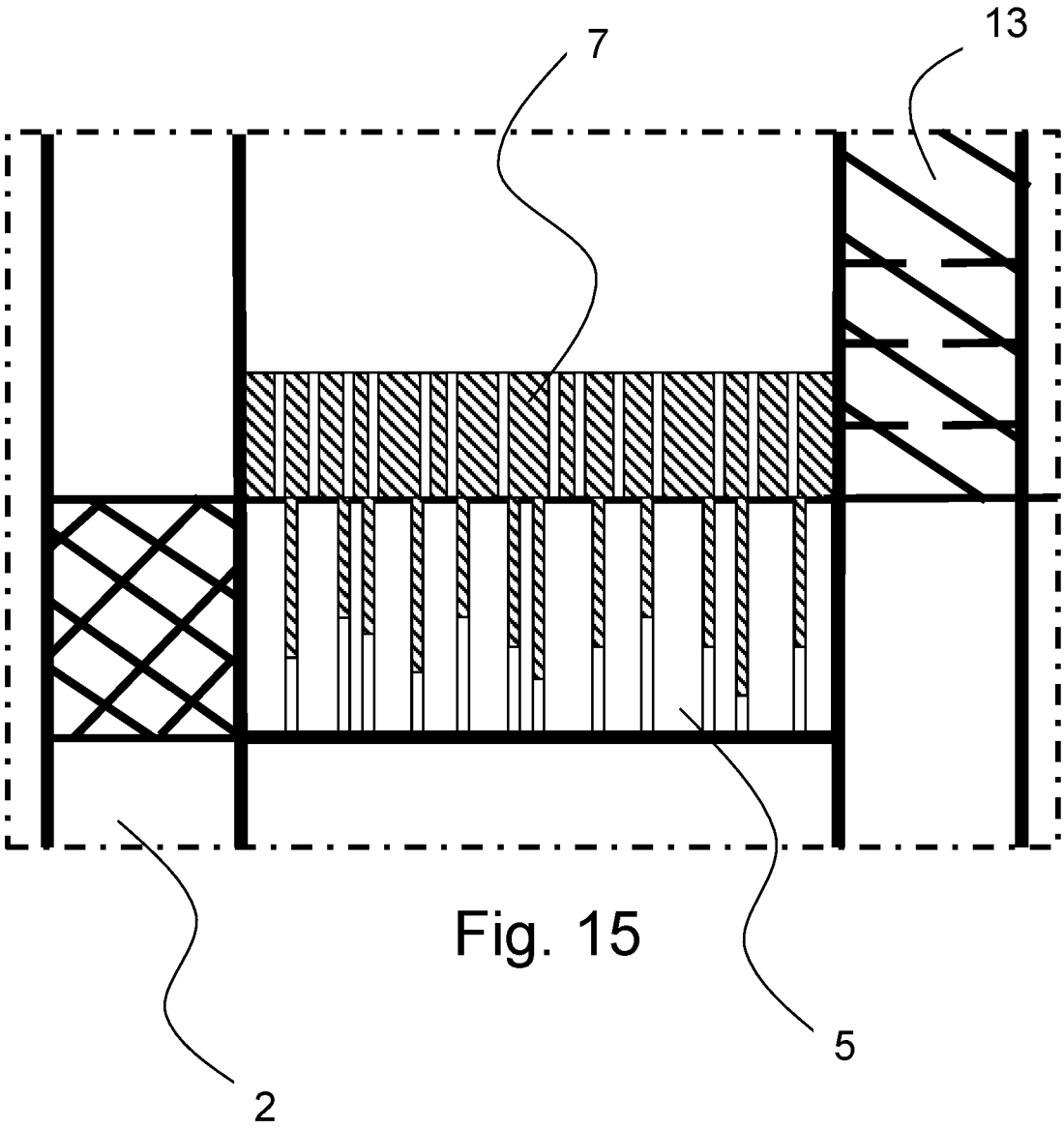
FIG. 15 is an enlarged view of portion "15" shown in FIG. 1.

As illustrated in FIG. 14*d*, the aperture 34 in the cap 32 may further comprise lobes 34'. The lobes 34' form channels between the central channel 4 and the vaporization chamber 10 in the cap 32. Hence, the vapour flows from the vaporization chamber 10 through the channels formed by the lobes 34' and then further through the central channel 4. The cap 32 is provided with an internal end surface 35 that is in contact with the central channel 4 and configured to seal against the central channel 4. The lobes 34' are preferably off set in relation to the inlet holes 11 so as to ensure that the airflow moves along the heating element 7 to entrain most vapour.

Figure 13A:
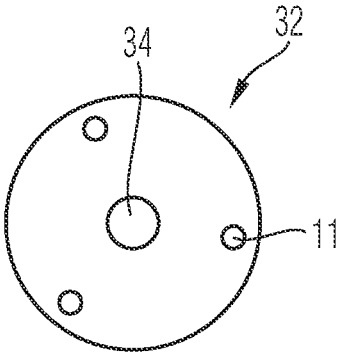
FIG. 13*a/b* are schematic cross-sectional side and top views of a cap for a vaporizer unit according to further embodiments.
Figure 13B:
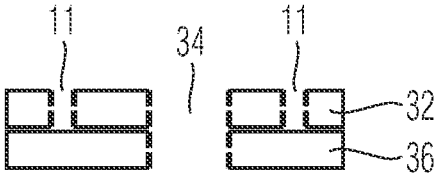

As seen in FIGS. 13*a* and 13*b*, the inlet holes 11 may be covered by a liquid impermeable membrane 36. Hence, the liquid impermeable membrane 36 may be permeable to air, but impermeable to liquid. In order to provide a sufficient air inlet flow rate, the area of the inlet holes 11 can be increased.

Figure 11A:
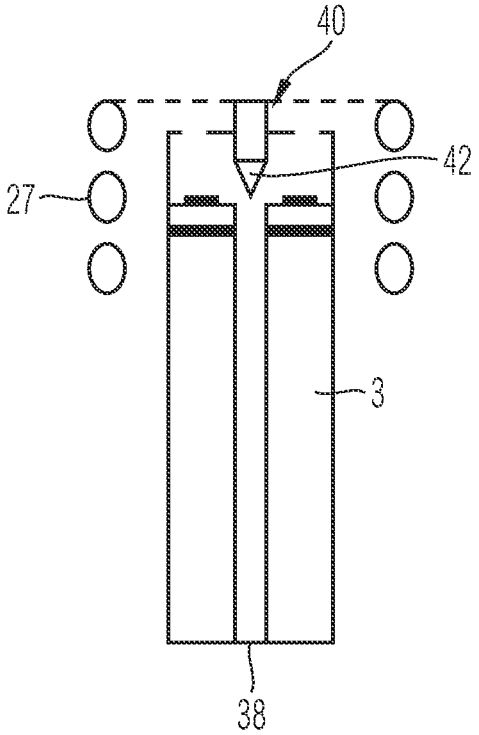
FIG. 11*a/b* are schematic cross-sectional side and top views of a vaporizer unit according to further embodiments.
Figure 11B:
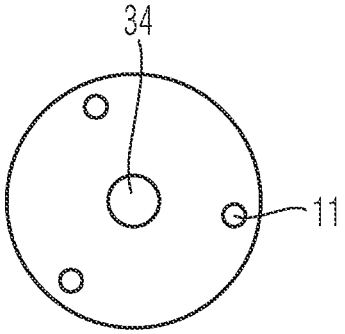

As seen in FIGS. 11*a* and 11*b*, the personal vaporizer device may be further provided with a temperature sensing system 40. The temperature sensing system 40 may be located inside the personal vaporizer device 50 and may comprise a sensor 42, a memory 62 and a controller 64. The memory 62 and the controller 64 are preferably located in the power supply portion 54. The sensor 42 can be a resistance thermometer, such as a PT100 sensor. The sensor 42 may have a protruding measuring probe (not shown) having an elongate shape. The protruding measuring probe may be configured to extend into the vaporization chamber 10 of the vaporizer unit 1 when the vaporizer unit 1 is located in the cavity 56 as replaceable cartridge. The protruding measuring probe may therefore be provided with a tip.

The tip facilitates the introduction of the protruding measuring probe into the vaporizer unit 1.

The protruding measuring probe may be provided with an external housing and a sensing wire located within the housing. The sensing wire can be a pure material, typically platinum, nickel, or copper. As the material has a specific predefined resistance/temperature relationship it can be used to provide an indication of temperature. The controller 64 may be configured to determine the changes in resistance and translate the determined change into a temperature.

Such a temperature sensing system is particularly easy to implement in the vaporizer unit 1 adapted for induction heating, as no electrodes are provided in the proximity of the vaporization chamber 10. To this effect, the vaporizer unit 1 may be provided with an aperture 34 through which the protruding measuring probe can extend. In an embodiment, the aperture 34 is provided with a pierceable membrane, such as liquid impermeable membrane 36. The liquid impermeable membrane 36 reduces the risk of leakage. The liquid impermeable membrane 36 may comprise a flexible material such as natural rubber or silicone.

In use, the protruding measuring probe can be positioned to be located in the air vapour stream in the central channel 4. By positioning the protruding measuring probe in the vapour stream, the vapour temperature can be measured.

Alternatively, the protruding measuring probe can be positioned in the vaporization chamber 10. This enables the temperature sensing system to measure the actual temperature and control the temperature in the vaporization chamber 10. By controlling the vaporization temperature, the vaporization can be performed more efficiently so that more liquid is transferred into vapour form and, hence, less liquid projections are formed. If the temperature is too high, there is a risk of creating an excessive amount of undesired volatile compounds, and if the temperature is too low, liquid in the liquid delivery member 5 might be brought into a boiling state in which liquid projections are formed. This is undesirable as larger droplets can enter the vapour stream and reach the user.

Figure 12:
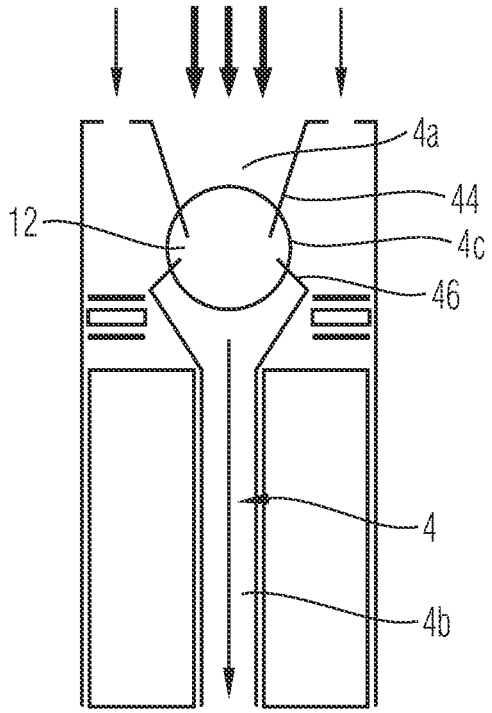
FIG. 12 is a schematic cross-sectional side view of a vaporizer unit according to further embodiments.

As seen in FIG. 12, central channel 4 of the vaporizer unit 1 can be provided with a constricted portion formed by guiding walls 44, 46. The central channel 4 is thus provided with a constriction section 4*c*, and an upstream portion 4*a* and a downstream portion 4*b* in relation to the constricted section 4*c* and in the direction of the vapour flow through the central channel 4. The central channel 4 has a narrower cross-sectional area in the constricted portion 4*c* area than the upstream portion 4*a* and the downstream portion 4*b*. The vaporization chamber 10 is provided with at least one outlet hole 12 arranged in the constricted region 4*c* of the central channel 4.

According to the Venturi effect, the airflow through the central channel 4 is faster in the constricted section 4*c* than in the upstream 4*a* and downstream portion 4*b*. Consequently, a region of low pressure is formed at the constricted portion that vapour is drawn in from the vaporization chamber 10.

The vapour inside the vaporization chamber 10 comprises vapour particles of different dimensions. The force required to move the smaller particles out of the vaporization chamber 10 and into the central channel 4 is less than the force required to move the larger particles. Due to the low pressure created in the constricted region 4*c*, smaller particles are drawn into the main vapour flow through the central channel 4, while larger particles remain inside the vaporization chamber 10.

By controlling the size and configuration of the narrowest part 4*c* of the vaporization chamber 10, both air flow speed and air flow direction can be regulated, and particle size of the resulting aerosol can be controlled more precisely and in particular reduced relative to other devices.

In an embodiment, the taper angle of the upstream portion 4*a* is 30° and the taper angle of the downstream portion 4*b* is 5°. The taper angles have been identified to provide an optimum increase in air flow rate at the constricted section 4*c*. This results in a suitable pressure differential across the vaporization chamber 10 of the vaporizer unit 1.

As shown in FIG. 12, the walls of the vaporization chamber 10 each taper inwardly from the inlet hole 11 and the outlet hole 12 respectively towards the narrowest part or constricted section 4*c* of the vaporization chamber 10. In an exemplary embodiment, the constricted section 4*c* may have a cross-sectional area of between 1 mm and 5 mm.

In use, air that enters the central channel 4 will accelerate from the inlet hole 11 towards the constricted section 4*c* and then gradually decelerate from the narrowest part or constricted section 4*c* towards the outlet 38, and air flow will be fastest at the narrowest part or constricted section 4*c*.

Although specific embodiments of the invention are illustrated and described herein, it will be appreciated by those of ordinary skill in the art that a variety of alternate and/or equivalent implementations exist. It should be appreciated that the exemplary embodiment or exemplary embodiments are examples only and are not intended to limit the scope, applicability, or configuration in any way. Rather, the foregoing summary and detailed description will provide those skilled in the art with a convenient road map for implementing at least one exemplary embodiment, it being understood that various changes may be made in the function and arrangement of elements described in an exemplary embodiment without departing from the scope as set forth in the appended claims and their legal equivalents. Generally, this application is intended to cover any adaptations or variations of the specific embodiments discussed herein.

It will also be appreciated that in this document the terms "comprise", "comprising", "include", "including", "contain", "containing", "have", "having", and any variations thereof, are intended to be understood in an inclusive (i.e. non-exclusive) sense, such that the process, method, device, apparatus or system described herein is not limited to those features or parts or elements or steps recited but may include other elements, features, parts or steps not expressly listed or inherent to such process, method, article, or apparatus. Furthermore, the terms "a" and "an" used herein are intended to be understood as meaning one or more unless explicitly stated otherwise. Moreover, the terms "first", "second", "third", etc. are used merely as labels, and are not intended to impose numerical requirements on or to establish a certain ranking of importance of their objects.

LIST OF DRAWING SIGNS

1 vaporizer unit or cartridge
2 housing
2' receptacle part
3 reservoir
4 central channel
5 liquid delivery member or end wall or first liquid delivery member
5' second liquid delivery member
6 heater
7 heating element
**7*a*** thinner portion
**7*b*** wider portion
8 outer surface of end wall
9 airflow path or passage
10 vaporization chamber
11 inlet hole
12 outlet hole
13 first electrode
14 first insulator
15 second electrode
16 second insulator
20 personal vaporizer device or e-cigarette
21 casing
22 mouthpiece
23 air inlet hole
24 end region of casing
25 electrode
26 electrode
27 induction coil
L liquid to be vaporized
V vapour
C electrical current
**4*a*** upstream portion
**4*b*** downstream portion
**4*c*** constricted portion
32 cap
34 aperture
35 internal end surface
36 membrane
38 outlet
42 sensor
44 guiding walls
46 guiding walls
50 personal vaporizer device or electronic cigarette
52 mouthpiece portion
54 power supply portion or main body
56 cavity
58 power supply unit or battery
60 electrical circuitry
62 memory
64 controller
72 central internal portion
74 fins or spokes

The invention claimed is:

1. A vaporizer unit for a personal vaporizer device, comprising:

an exterior housing which encloses a reservoir for storing a liquid to be vaporized;

a heating element configured and arranged for heating the liquid to be vaporized to generate a vapour to be inhaled;

a liquid delivery means which is configured to convey the liquid from the reservoir to the heating element for vaporization;

wherein the liquid delivery means comprises at least a first side configured to be in contact with or to form a wall of the reservoir and a second side in contact with the heating element fluidly connected with the first side and wherein the heating element comprises an electrically conductive cover or coating applied to the second side of the liquid delivery means, wherein the liquid delivery means comprises a porous material configured to convey the liquid from the reservoir to the heating element via capillary action, and wherein the electrically conductive cover or coating is a coating that at least partially extends into at least a portion of individual pores on a surface of the porous material forming the liquid delivery means, and wherein the electrically conductive cover or coating provided on the wall of the reservoir formed by the liquid delivery means is substantially porous or includes a plurality of holes for transmission of liquid and/or vapour therethrough.

2. The vaporizer unit of claim 1, wherein the heating element is a cover in the form of a flat disc-shaped element.

3. The vaporizer unit of claim 1, wherein a vaporization chamber is formed at an end-portion of the vaporizer unit, the liquid delivery means and the heating element being housed within the vaporization chamber.

4. The vaporizer unit of claim 3, wherein the liquid delivery means comprises a central opening or aperture that surrounds and communicates with a central channel of the vaporizer unit.

5. The vaporizer unit of claim 4, wherein the vaporization chamber has a vapour outlet in communication with the central channel.

6. The vaporizer unit of claim 5, wherein the central channel has a constricted section, an upstream portion and a downstream portion, wherein the constricted portion has a reduced cross-sectional area in relation to the upstream portion, and wherein the vapour outlet of the vaporization chamber is located in the constricted section.

7. The vaporizer unit of claim 5, wherein the vaporizer unit is configured to receive an airflow entering or passing through the central opening or aperture of the liquid delivery means after interfacing with or contacting the electrically conductive cover or coating of the heating element.

8. The vaporizer unit of claim 4, wherein a first electrode is provided to connect the electrically conductive cover or coating of the heating element with a power source, wherein the first electrode is arranged centrally of the housing for contact with a central region of the electrically conductive cover or coating.

9. The vaporizer unit of claim 8, wherein the first electrode has a generally tubular configuration having an opening on its surface, wherein the opening is configured to receive an airflow passing therethrough.

10. The vaporizer unit of claim 8, wherein a second electrode is provided to connect the electrically conductive cover or coating of the heating element with the power source, wherein the second electrode is arranged outside a region of the electrically conductive cover or coating; wherein the second electrode at least partly surrounds the electrically conductive cover or coating, and comprises a side wall of the housing that substantially surrounds or encompasses an end wall of the reservoir.

11. The vaporizer unit of claim 1, further comprising a second liquid delivery means arranged on an opposite side of the heating element in relation to the first liquid delivery means.

12. The vaporizer unit of claim 1, further comprising a cap that forms part of the exterior housing at an end-portion of the vaporizer unit, the cap comprising air inlet holes and a central opening.

13. The vaporizer unit of claim 12, further comprising a membrane configured to seal the air inlet holes to be air permeable and liquid impermeable.

14. The vaporizer unit of claim 1, wherein the electrically conductive cover or coating is a coating that is deposited on the liquid delivery means.

15. The vaporizer unit of claim 1, wherein the liquid delivery means is flat or plate-like and forms at least a part of the wall of the reservoir for storing the liquid to be vaporized, the electrically conductive cover or coating at least partially covering an outer surface of the wall.

16. The vaporizer unit of claim 15, wherein an electric current flows radially through the electrically conductive cover or coating.

17. The vaporizer unit of claim 1, wherein the electrically conductive cover or coating comprises a susceptor which is adapted to be heated by an induction coil.

18. The vaporizer unit of claim 1, wherein the surface area not covered by the electrically conductive cover or coating is 30% or less of the whole surface area on the wall of the reservoir formed by the liquid delivery means.

19. A personal vaporizer device comprising the vaporizer unit of claim 1, the vaporizer unit being replaceable and/or disposable.

20. The personal vaporizer device of claim 19, further comprising a receiving cavity adapted to engage with the vaporizer unit, wherein a temperature sensor is located in the receiving cavity, the temperature sensor comprising a measuring probe having a first end attached to the receiving cavity and a second protruding free end.

21. The personal vaporizer device of claim 20, wherein the protruding free end has a tip.

* * * * *